US006273997B1

(12) United States Patent
Ehrhardt et al.

(10) Patent No.: US 6,273,997 B1
(45) Date of Patent: Aug. 14, 2001

(54) ROSIN/HYDROCARBON RESIN SIZE FOR PAPER

(75) Inventors: Susan M. Ehrhardt, Haddenfield, NJ (US); D. Bruce Evans, Bethlehem, PA (US)

(73) Assignee: Hercules Incorporated, Wilmington, DE (US)

( * ) Notice: Subject to any disclaimer, the term of this patent is extended or adjusted under 35 U.S.C. 154(b) by 0 days.

(21) Appl. No.: 09/617,359

(22) Filed: Jul. 17, 2000

Related U.S. Application Data

(63) Continuation of application No. 08/365,393, filed on Dec. 28, 1994, now abandoned.

(51) Int. Cl.[7] ..... D21H 17/04; D21H 21/16

(52) U.S. Cl. ..... 162/158; 162/173; 162/164.3; 162/164.6; 162/168.2; 162/180; 162/183

(58) Field of Search ..... 162/164.3, 173, 162/180, 164.6, 168.2, 183, 158, 164.1

(56) References Cited

U.S. PATENT DOCUMENTS

| | | | |
|---|---|---|---|
| 2,601,597 | 6/1952 | Daniel et al. | 92/21 |
| 2,628,918 | 2/1953 | Wilson et al. | 106/238 |
| 2,684,300 | 7/1954 | Wilson et al. | 92/3 |
| 3,077,430 | 2/1963 | Moore | 162/168 |
| 3,186,900 | 6/1965 | De Young | 162/164 |
| 3,193,449 | 7/1965 | Aldrish et al. | 162/180 |
| 3,248,353 | 4/1966 | Thomas | 260/29.2 |
| 3,382,142 | 5/1968 | Himes et al. | 162/168 |
| 3,478,007 | 11/1969 | Barkley et al. | 260/88.2 |
| 3,526,524 | 9/1970 | Kullick | 106/238 |
| 3,565,755 | 2/1971 | Davison | 162/168 |
| 3,865,769 | 2/1975 | Davison | 260/27 R |
| 3,966,654 | 6/1976 | Aldrich | 260/24 |
| 4,109,053 | 8/1978 | Aldrich | 428/413 |
| 4,219,382 | 8/1980 | Leffler | 162/180 |
| 4,240,295 | 12/1980 | Uranishi | 73/607 |
| 4,323,425 | 4/1982 | Dowthwaite et al. | 162/168 |
| 4,522,686 | 6/1985 | Dumas | 162/158 |
| 4,591,412 | 5/1986 | Hechler | 162/158 |
| 4,722,964 | 2/1988 | Chan et al. | 524/608 |
| 4,857,149 | 8/1989 | Tiedeman et al. | 162/158 |
| 4,878,999 | 11/1989 | Gowan, Jr. | 162/164 |
| 5,192,363 | 3/1993 | Bussell et al. | 106/218 |
| 5,320,712 | 6/1994 | Sawayama et al. | 162/168.2 |
| 5,393,337 | 2/1995 | Nakamura et al. | 106/238 |
| 5,393,338 | 2/1995 | Pudney et al. | 106/238 |
| 5,510,003 | 4/1996 | Colasurdo et al. | 162/158 |
| 6,033,526 | 3/2000 | Ehrhardt et al. | 162/180 |

FOREIGN PATENT DOCUMENTS

| | | |
|---|---|---|
| 746057 | 11/1966 | (CA) . |
| 266820 | 4/1989 | (DE) . |
| 333368 | 9/1989 | (EP) . |
| 1266829 | 3/1972 | (GB) . |
| 1412254 | 10/1975 | (GB) . |
| 56169898 | 12/1981 | (JP) . |
| 01239193 | 9/1989 | (JP) . |
| 711219 | 1/1980 | (SU) . |
| 549219 | 6/1990 | (SU) . |

OTHER PUBLICATIONS

Biermann, C.J., "Rosin sizing with polyamine mardants from pH 3 to 10," *Tappin Journal*, 1992, 166–171.

Poppel, E., et al., "Practical and theoretical results in the field of wet strength paper manufactured with epi–polyamine–polyamide resin" (translation), *Da Papier*, 1969, 23, 672–682.

*Primary Examiner*—Peter Chin
(74) *Attorney, Agent, or Firm*—Gary A. Samuels

(57) ABSTRACT

Discloses is a method for sizing paper at a pH of about 5.0 to about 8.5 by incorporating a sizing composition consisting essentially of (a) rosin, (b) at least one hydrocarbon resin, (c) a cationic component consisting essentially of a cationic polyamine resin at a weight ration of the rosin/hydrocarbon resin blend to cationic polyamine of about 5:1 to about 1:2, and (d) up to 0.3% alum. The cationic polyamine resin is selected from the group consisting of polyalkyleneamine-epihalohydrin resins, polyalkyleneamine-dicyandiamide-epihalohydrin resins, poly(diallylamine•HCl)-epihalohydrin resins, poly (methyldiallylamine•HCl)-epihalohydrin resins, epihalohydrin-modified polyethyleneimine resins, amine-modified poly(methyldiallylamine•HCl)-epihalohydrin resins, and mixtures thereof.

64 Claims, No Drawings

ROSIN/HYDROCARBON RESIN SIZE FOR PAPER

CROSS-REFERENCE TO RELATED APPLICATIONS

This application is a continuation of U.S. patent application Ser. No. 08/365,393, filed Dec. 28, 1994, now abandoned which is incorporated herein in its entirety by reference.

FIELD OF THE INVENTION

This invention relates to rosin sizes for paper.

BACKGROUND OF THE INVENTION

Sizing agents are used by the paper industry to give paper and paperboard some degree of resistance to wetting and penetration by aqueous liquids. There are two basic categories of sizing agents: acid and alkaline. Acid sizing agents are intended for use in acid papermaking systems, traditionally less than pH 5. Analogously, alkaline sizing agents are intended for use in alkaline papermaking systems, typically at a pH greater than 6.5.

Most acid sizing agents are based on rosin. The development of sizing with a rosin-based size is dependent upon its reaction with papermaker's alum, $Al_2(SO_4)_3 \cdot 14–18\ H_2O$. Since aluminum species that exist predominantly at a low pH (<pH 5) are required for the appropriate interactions needed to effect sizing, rosin and alum have been used primarily in acid papermaking systems. It has been shown that, by proper selection of addition points in the papermaking system and by using cationic dispersed rosin sizes, rosin-based sizes can be used in papermaking systems up to about pH 7, thus extending the range of acid sizes. However, due to the limitations imposed by alum chemistry, the efficiency of rosin-based sizes decreases above about pH 5.5.

Sizing agents developed for papermaking systems above pH 6.5 are generally based on alkyl ketene dimer (AKD) or alkenyl succinic anhydride (ASA). AKD sizes function by forming covalent bonds with cellulose to give proper orientation and anchoring of the hydrophobic alkyl chains. This covalent bond formation makes AKD sizing very efficient and resistant to strong penetrants. However, AKD sizes have some limitations: small changes in the amount of size added can lead to large differences in sizing (steep sizing response curve), and there is a slow rate of sizing development (cure).

The other major alkaline sizing agent is based on ASA. As with AKD, the development of sizing with ASA sizes is also dependent on the formation of covalent bonds with cellulose to give proper orientation and anchoring. ASA is more reactive than AKD, resulting in the greater development of sizing on-machine. However, the reaction rate with water is also greater, producing a hydrolyzate that is an inefficient sizing agent in alkaline systems and contributes to the formation of deposits on the papermaking machine. To minimize the formation of hydrolyzate, ASA is typically emulsified at the mill immediately before addition to the papermaking system.

Cationic resins have been used previously in the papermaking process, although not the cationic resins of this invention in combination with a rosin/hydrocarbon blend in the absence of alum or with amounts of alum ≦0.3%, based on the dry weight of paper pulp. For example, U.S. Pat. No. 3,193,449 discloses sizing paper with an aqueous emulsion of a partially saponified terpene resin, 1–5% alum, and optionally a partially saponified rosin. U.S. Pat. No. 4,323,425 discloses sizing in the absence of alum with an aqueous dispersion of fortified rosin, an optional hydrocarbon resin and a vinyl imidazoline polymer as a retention aid. Canadian Patent 746,057 discloses a sizing composition for paper comprising an aqueous dispersion of partially neutralized rosin, a terpene polymer, and 1–5% aluminum sulfate, based on the dry weight of the pulp.

There is still a need for a rosin sizing system for use at a neutral to alkaline pH that does not have the disadvantages of ASA and AKD sizes.

SUMMARY OF THE INVENTION

The method of this invention for sizing paper or paperboard comprises incorporating into the paper pulp at a pH of about 5.0 to about 8.5 a sizing composition consisting essentially of (a) rosin, (b) at least one hydrocarbon resin, (e) a cationic component consisting essentially of a cationic polyamine resin, wherein the weight ratio of the rosin/hydrocarbon resin blend to cationic polyamine is about 5:1 to about 1:2. preferably about 1:1, and the cationic polyamine is selected from the group consisting of polyalkyleneamine-epihalohydrin resins, polyalkyleneaminedicyandiamide-epihalohydrin resins, poly(diallylamine•HCl)-epihalohydrin resins, poly(methyldiallylamine•HCl)-epihalohydrin resins, epihalohydrin-modified polyethyleneimine resins, amine-modified poly(methyldiallylamine•HCl)-epihalohydrin resins and mixtures thereof, and (d) up to 0.3% alum, based on the dry weight of the pulp.

The rosin-based sizes of this invention are effective at a neutral to slightly alkaline pH. In papermaking, a pH of 6.5–7.5 is considered to be "neutral". Rosin-based sizes do not have the shortcomings associated with AKD and ASA alkaline sizing agents. Rosin sizes do not depend on covalent bond formation, therefore they do not have on-machine size development problems. Rosin is tacky, not waxy, therefore it is not expected to contribute to slip. It is also possible to make high solids (up to 50%) dispersions that have a relatively long shelf life of six months to a year. The sizing response curve for rosin sizes is gradual, not steep, and the sizes are relatively inexpensive.

DETAILED DESCRIPTION OF THE INVENTION

According to the present invention it has been discovered that rosin-based sizes can be used at a pH of about 5.0 to about 8.5, preferably about 5.5 to about 8.0, and most preferably about 6.0 to about 7.5, when certain cationic epihalohydrin-modified polyamine resins are present. The cationic resins are used to anchor the rosin to the paper pulp. The cationic polyamine resins suitable for use in the present invention are selected from the group consisting of polyalkyleneamine-epihalohydrin resins, polyalkyleneamine-dicyandiamide-epihalohydrin resins, poly(diallylamine•HCl)epihalohydrin resins, poly(methyldiallylamine•HCl)epihalohydrin resins, epihalohydrin-modified polyethyleneimine resins, and amine-modified poly(methyldiallylamine•HCl)-epihalohydrin resins. The weight ratio of rosin to cationic polyamine resin is preferably about 5:1 to about 1:2, more preferably about 1:1.

Exemplary cationic polyamine resins useful in accordance with the present invention include bis-hexamethylentriamine-epichlorohydrin resin, poly(methyldiallylamine•HCl)-epichlorohydrin resin, diethylenetriamine-dicyandiamide-epichlorohydrin resin, epichlorohydrin-modified polyethyleneimine resin, hexamethylenediamine-epichlorohydrin resin, poly (diallylamine•HCl)-epichlorohydrin resin, diethylenetriamine/epichlorohydrin resin, triethylenetetraamine/epichlorohydrin resin, tetraethylenepentaamine/epichlorohydrin resin, imino-bis-propylamine/epichlorohydrin resin, and 1–6 hexamethylenediamine-co-1,2-dichloroethane/epichlorohydrin resin.

The rosin used in the process of this invention can be any of the commercially available types of rosin such as, for example, wood rosin, gum rosin, tall oil rosin, and mixtures thereof, in their crude or refined state. Fortified rosin, partially or substantially completely hydrogenated rosins and polymerized rosins, as well as rosins that have been treated to inhibit crystallization such as by heat treatment or reaction with formaldehyde can also be used. Fortified rosins are typically prepared by well known procedures involving reacting rosin with acid compounds, including α,β-unsaturated monobasic and polybasic organic acids and acid anhydrides such as acrylic, maleic, fumaric, itaconic, and citraconic acids and their anhydrides. Preparation of fortified rosins is disclosed in U.S. Pat. Nos. 2,628,918 and 2,684,300, the disclosures of which are incorporated herein by reference. "Rosin size" also includes sizes prepared from rosin containing various amounts of fatty acids or fatty acid mixtures, e.g., a tall oil rosin fraction obtained from the fractional distillation of tall oil and containing up to several percent of a tall oil fatty acid mixture. The amounts of rosin useful in accordance with the method of the present invention typically vary from about 0.1 to about 1 weight %, based on the dry weight of the pulp used.

Preferably, a dispersed rosin size is used in accordance with the present invention. Dispersed rosin sizes are well known, such as those described in U.S. Pat. Nos. 3,565,755, 3,966,654, and 4,522,686, the disclosures of which are incorporated by reference in their entirety. The cationic polyamine resin can be added to the pulp separately or as part of the size emulsion. When added separately, it is preferable to add the cationic resin first, followed by the size. The cationic resins can be incorporated into the aqueous phase during emulsification or added after emulsification.

The sizing composition of this invention also contains a hydrocarbon resin blended with the rosin to improve sizing efficiency. A wide variety of hydrocarbon resins can be used in the formulation. They are generally made from terpene or fractionated petroleum feedstocks and are polymerized to a softening point of about 45° to about 150° C., preferably about 70° about to 110° C. The following feedstocks can be used alone or in combination steam distilled wood turpentine (SDWT), distilled sulfate turpentine (DST), alpha-pinene, beta-pinene, limonene, camphene, coumarone-indene, petroleum C-5 fractions, petroleum C-9 fractions, dicyclopentadiene, alphamethylstyrene, styrene, xylene, vinyltoluene, terpenes other than those mentioned above, and other aliphatic and aromatic petroleum hydrocarbon fractions. SDWT and DST contain primarily alpha- and beta-pinene.

The polymerization of the hydrocarbon feedstocks described above is carried out in a solvent using $AlCl_3$ or another Friedel-Crafts catalyst used for cationic polymerizations. The use of a trialkylsilicon halide cocatalyst such as trimethylchlorosilane can be used to improve reaction efficiency and yield. After polymerization, the solvent is stripped off and the resulting resin is steam stripped to a chosen softening point.

The polymerized hydrocarbon resin is then combined with about 10% to about 90% by weight rosin, based on the rosin/resin blend. Approximately about 20% to about 60% rosin is preferred. The rosin/hydrocarbon resin mixture is then emulsified in water to give a dispersion having a total solids content of about 5% to about 50% by weight, preferably about 35%. The dispersions can be formed by the solvent, high-temperature, invert, or other emulsification process. The dispersions can be stabilized using surfactants, casein or proteins. The cationic polyamine resins discussed previously can also serve as the emulsion stabilizer. Casein and the cationic polyamine resins are the preferred stabilizers.

A small amount of alum, typically 0.1 to 0.3%; by weight, based on the dry weight of the pulp, can also be present in the sizing composition of this invention, but its presence is not required. Alum acts to anchor the sizing agent to the paper pulp only at acid pH's. At neutral to alkaline pH's, as well as at acid pH's, it helps to retain fine particles on the paper pulp fibers, and to dissipate static charges. The term "alum" is meant to include papermaker's alum (aluminum sulfate) as well as other inorganic aluminum salts such as, for example, aluminum chloride, polyaluminum chlorides, aluminum chlorohydrate, and mixtures thereof. Aluminum sulfate is preferred.

The amounts of cationic resin and alum, if present, depend upon the type of papermaking machinery used, the temperature, the points of addition of the additives in the papermaking system, the amount of anionic materials present in the pulp, and the type of pulp. For example, mechanical pulp or pulp from recycled paper could contain larger amounts of anionic material and would therefore require larger amounts of alum and cationic resin than "cleaner" bleached kraft pulp.

The rosin-based size/cationic resin compositions of this invention can effectively size pulp furnishes containing clay, $TiO_2$, calcium carbonate, and other fillers.

High levels of size and/or cationic resin cause no significant reduction in the paper coefficient of friction.

In accordance with the present invention the sizing agents can be applied as internal sizing agents or surface sizing agents. Internal sizing involves adding the size to the paper pulp slurry before sheet formation, while surface sizing involves immersion of the paper in the sizing agent or spraying the sizing agent on the paper, followed by drying at elevated temperatures in accordance with known drying techniques. The present invention is useful in sizing paper materials such as, for example, printing and writing paper and liner board.

In this specification, all parts and percentages are by weight unless indicated otherwise.

The Hercules Size Test (HST) is a standard test in the industry for measuring the degree of sizing. This method employs an aqueous dye solution as the penetrants to permit optical detection of the liquid front as it moves through the sheet. The apparatus determines the time required for the reflectance of the sheet surface not in contact with the penetrants to drop to a predetermined percentage of its original reflectance. All HST testing data reported measure the seconds to 80% reflection with 1% formic acid ink unless otherwise noted. The use of formic acid ink in a more severe test than neutral ink and tends to give faster test times. High HST values are better than low values. The amount of sizing desired depends upon the kind of paper being made and the system used to make it.

In the following examples, evaluations were made using a blend of hardwood and softwood bleached kraft pulps (70% Weyerhaeuser bleached hardwood kraft, 30% Rayonier bleached softwood kraft) refined to a Canadian standard freeness (CSF) of 500 cc. The water for dilutions was adjusted to contain 100 ppm hardness and 50 ppm alkalinity.

A pilot scale papermachine designed to simulate a commercial Fourdrinier was used, including stock preparation, refining and storage. Dry lap pulp was refined at 2.5% consistency in a double, disc refiner by recirculation until the desired freeness was reached. The stock was then pumped to a machine chest where it was diluted with fresh water to approximately 1.0% solids.

The stock was fed by gravity from the machine chest to a constant-level stock tank; from there, the stock was pumped to a series of in-line mixers (mix boxes) where wet end additives were added. After passing through the mix boxes, the stock entered the fan pump where further chemical additions could be made. The stock was diluted with white water at the fan pump to about 0.2% solids.

The stock was pumped from the fan pump to a flow spreader and then to the slice, where it was deposited onto the 12-inch wide Fourdrinier wire. Immediately after its deposition on the wire, the sheet was vacuum-dewatered via two vacuum boxes; couch consistency was normally 14–15%.

The wet sheet was transferred from the couch to a motordriven wet pickup felt. At this point, water was removed from the sheet and the felt by vacuum uhle boxes operated fron a vacuum pump. The sheet was further dewatered in a single-felted press and left the press section at 38–40% solids.

A 65 g/m$^2$ (40 lb/3000 ft$^2$ ream) sheet was formed and dried an four dryer cans to 3–5% moisture (internal dryer can temperatures were 180, 200, 220 and 240° F.).

The cationic resins, rosin-based sizing agents and alum were added to the pulp slurry before sheet formation, as specified in each example. If needed, pH was adjusted using caustic or sulfuric acid at the first mixer.

EXAMPLE 1

This example describes the sizing of paper using a blend of various hydrocarbon resins and rosin size and a cationic polyamine resin of this invention, with and without alum. A comparison with rosin/hydrocarbon resin sizing compositions containing several cationic resins that are not a part of this invention is also presented.

A. Preparation of Steam Distilled Wood Turpentine/Rosin Size

Steam distilled wood turpentine (SDWT) resin was polymerized following the procedure described in U.S. Pat. No. 3,478,007, the disclosure of which is incorporated by reference in its entirety.

A fortified rosin size was prepared by reacting formaldehyde-treated tall oil rosin (92.5 parts) with furmaric acid (7.5 parts) at a temperature of about 205° C. After substantially all of the furmaric acid reacted, the fortified rosin was cooled to room temperature (about 23° C.). The fortified rosin contained 7.5% furmaric acid, substantially all of which was in the combined or adducted form.

The SDWT resin was blended with the tall oil rosin at a ratio of 9:1 SDWT:rosin to make the size for emulsification.

An organic phase was prepared by blending 300 g of the 9:1 SDWT/rosin size with 200 g of methylene chloride until dissolved. An aqueous phase was prepared by combining 800 g of distilled water, 28 g of casein, and 92 g of 4% NaOH and heating the mixture to 40° C. for 30 minutes. Both phases were combined and blended for two minutes, then homogenized in a piston homogenizer, two passes at 3000 psi. The methylene chloride was stripped off up to a maximum temperature of 100° C. for five minutes. The final product was filtered through a 100 mesh screen to remove any breakout that occurred during formulation.

A size emulsion having total solids of about 35%, a negligible amount of breakout, and a particle size of 0.3–0.5 microns was produced.

B. Preparation of C-5/Styrene/Rosin Size

Hercotac® LA-95 hydrocarbon resin, available from Hercules Incorporated, Wilmington, Del., U.S.A., was blended 9:1 with 7.5% fortified tall oil rosin to form a size as described in Section A. Hercotac® LA-95 is a modified C-5 hydrocarbon resin having a softening point of 90–96° C.

The 9:1 blend of hydrocarbon resin/fortified rosin was emulsified using casein by the solvent process described in section A. A size emulsion having total solids of about 35%, a negligible amount of breakout, and a particle size of 0.3–0.5 microns was produced.

C. Preparation of a Vinyltoluene/Alpha-Methylstyrene/Rosin Size

Piccotex® 75 hydrocarbon resin, available from Hercules Incorporated, Wilmington, Del., U.S.A., was blended 9:1 with 7.5% fortified tall oil rosin to form a size as described in section A. Piccotex® 75 hydrocarbon rosin is made from a blend of vinyltoluene and alpha-methylstyrene and has a softening point of 72–78° C.

The 9:1 blend of Piccotex® 75 hydrocarbon resin/fortified rosin was emulsified using casein by the solvent process as described in section A. A size emulsion having a total solids of about 35%. a negligible amount of breakout, and a particle size of 0.3–0.5 microns was produced.

D. Sizing Evaluation

The size emulsions prepared in sections A, B, and C were evaluated using a bis(hexamethylenetriamine)-epichlorohydrin cationic resin, prepared as described in Example 9 of U.S. Pat. No. 3,966,654.

A comparison was also made with the same size emulsions that contained cationic resins that are not a part of the present invention: polyamidoanine-epichlorohydrin cationic resin, available as KYMENE® 557H from Hercules Incorporated, Wilmington, Del., U.S.A.; Polyethyleneimine available from Aldrich Chemical Co., Inc., Milwaukee, Wis., U.S.A.; and cationic potato starch available as HiCat™ 142 from Roquette Freres, Lestrem, France.

A pilot papermachine was used with a furnish comprising 70% bleached hardwood kraft and 30% bleached softwood kraft. The pulp was refined in a double disc refiner to 490 ml Canadian standard freeness (CSF). The water used had 100 ppm hardness and 50 ppm alkalinity and was adjusted to pH 7.5 for all runs. The cationic resin (added first) and size were added to the thick stock using in-line mixers. Alum, when used, was added at the fan pump. The paper was dried on drum driers to 3.5–5.0% moisture. After one week natural aging, the paper was tested using the Hercules Size Test (HST). Test Ink #2 (1% formic acid ink) and 80% reflectance endpoint were used throughout. The data are given in Table 1.

TABLE 1

| % Cationic Resin Added | Size | % Size Added | % Alum Added | HST (seconds) |
|---|---|---|---|---|
| Bis(hexamethylenetriamine)-epichlorohydrin Resin | | | | |
| 0.4 | A | 0.4 | 0.25 | 863 |
| 0.4 | B | 0.4 | 0.25 | 713 |
| 0.4 | C | 0.4 | 0.25 | 758 |
| 0.4 | A | 0.4 | 0 | 1177 |
| 0.4 | B | 0.4 | 0 | 790 |
| 0.4 | C | 0.4 | 0 | 650 |
| 0.2 | A | 0.4 | 0 | 619 |
| 0.2 | B | 0.4 | 0 | 468 |

TABLE 1-continued

| % Cationic Resin Added | Size | % Size Added | % Alum Added | HST (seconds) |
|---|---|---|---|---|
| 0.2 | C | 0.4 | 0 | 459 |
| 0.3 | A | 0.3 | 0.25 | 956 |
| 0.2 | A | 0.2 | 0.25 | 452 |
| 0.1 | A | 0.1 | 0.25 | 4 |
| 0.1 | A | 0.4 | 0.25 | 434 |
| | | Kymene ® 557H | | |
| 0.4 | A | 0.4 | 0 | 0 |
| 0.4 | A | 0.4 | 0.25 | 174 |
| 0.4 | B | 0.4 | 0.25 | 50 |
| 0.4 | C | 0.4 | 0.25 | 79 |
| | | Polyethyleneimine | | |
| 0.4 | A | 0.4 | 0 | 0 |
| 0.4 | A | 0.4 | 0.25 | 3 |
| 0.4 | B | 0.4 | 0.25 | 0 |
| 0.4 | C | 0.4 | 0.25 | 1 |
| | | Cationic Potato Starch | | |
| 0.4 | A | 0.4 | 0 | 0 |
| 0.4 | A | 0.4 | 0.25 | 11 |
| 0.1 | A | 0.4 | 0.25 | 59 |

The data show that alum is not required to obtain sizing when using the cationic resins of this invention. In addition, effective sizing is possible at relatively low levels of cationic resin and/or size. The data also show that the size compositions that contain cationic resins that are not part of this invention are very ineffective.

EXAMPLE 2

This example shows the effect of pH and alum on sizing efficiency of a dispered rosin size containing a cationic polyamine of this invention, with and without the addition of a hydrocarbon resin.

A. Preparation of Steam Distilled Wood Turpentine/Rosin Size

A steam distilled wood turpentine (SDWT) resin made according to Example 1A was steam stripped to give a resin with a softening point of 92° C. The SDWT resin was blended 60/40 with fortified tall oil rosin, prepared as described in Example 1.

The blend was emulsified as follows. An organic phase was prepared by blending 700 g of the SDWT/rosin size with 467 g of methylene chloride until dissolved. An aqueous phase was prepared by combining 151.7 g of his (hexamethylenetriamine)-epichlorohydrin cationic resin prepared as described in Example 9 of U.S. Pat. No. 3,966,654, (38.9% total solids, 59 g dry solids), and 132 g distilled water. The pH of the aqueous phase was adjusted to 4.2 with NaOH. Both phases were combined and blended for three minutes, then homogenized in a piston homogenizer, two passes at 3000 psi. The methylene chloride was stripped off up to a maximum temperature of 100° C. for five minutes. The final product was filtered through a 100 mesh screen to remove any breakout that occurred during formulation.

An emulsion having total solids of about 35%, a negligible amount of breakout, and a particle size of 0.3–0.5 microns was produced.

B. Preparation of Rosin Size Without SDWT Resin

The procedure described in section A above was repeated using all fortified tall oil rosin dispersed size in place of the SDWT resin/fortified tall oil rosin blend. An emulsion of similar quality and particle size was produced.

Sizes A and B were evaluated on a pilot papermachine as described in Example 1. The system pH was adjusted by adding caustic or acid, as required, to the thick stock prior to addition of other wet end additives. Naturally aged (NA) HST results (naturally aged for four weeks) are given in Table 2 below.

TABLE 2

Sizing Data for SDWT Resin/Rosin and Rosin Sizes at pH 5.5 to 8.5

| Wet End Additives | Size (0.4%) | NA HST at Given pH 5.5 | 6.5 | 7.5 | 8.5 |
|---|---|---|---|---|---|
| Alum Only | A | 326 | 215 | 216 | 1 |
| | B | 381 | 224 | 40 | 0 |
| Cationic resin Only | A | C | 591 | 555 | 594 |
| | B | — | 138 | 93 | 8 |
| Alum + Cationic Resin | A | 439 | 529 | 531 | 398 |
| | B | 616 | 402 | 41 | 3 |

Alum Addition
pH 5.5: 1.0%
pH 6.5 0.5%
pH 7.5, 8.5: 0.25%
Cationic Resin Addition – all pH = s: 0.1%

It is not intended that the examples given here should be construed to limit the invention, but rather they are submitted to illustrate some of the specific embodiments of the invention. Various modifications and variations of the present invention can be made without departing from the scope of the appended claims.

What is claimed is:

1. A method for sizing paper or paperboard, said method consisting essentially of incorporating into the paper or paperboard pulp at a pH of about 5.0 to about 8.5 a sizing composition consisting essentially of (a) about 0.1 to about 1% by weight of rosin, based upon the dry weight of the pulp, (b) about 10 to about 90% of at least one hydrocarbon resin, based upon the total weight of the rosin and hydrocarbon resin, (c) a cationic component consisting essentially of a cationic polyamine resin, wherein the weight ratio of the rosin and hydrocarbon resin to cationic resin is about 5:1 to about 1:2 and the cationic polyamine resin is selected from the group consisting of polyalkyleneamine-epihalohydrin resins, polyalkyleneamine-dicyandiamide-epihalohydrin resins, poly(diallylamine•HCl)-epihalohydrin resins, poly (methyldiallylamine•HCl)-epihalohydrin resins, epihalohydrin-modified polyethyleneimine resins, amine-modified poly(methyldiallylamine•HCl)-epihalohydrin resins, and mixtures thereof, and (d) up to 0.3% alum, based on the dry weight of the pulp.

2. The method of claim 1, wherein the pH is about 5.5 to about 8.0.

3. The method of claim 2, wherein the pH is about 6.0 to about 7.5.

4. The method of claim 1, wherein the weight ratio of rosin to cationic polyamine is about 1:1.

5. The method of claim 1, wherein alum is present in an amount of 0.1 to 0.3% by weight, based on the dry weight of the pulp.

6. The method of claim 5, wherein the alum is aluminum sulfate.

7. The method of claim 1, wherein the method is carried out in the absence of alum.

8. The method of claim 7, wherein the method is carried out in the absence of aluminum sulfate.

9. The method of claim 1, wherein the hydrocarbon resin is made from monomers selected from the group consisting of polymerized steam distilled wood turpentine, distilled sulfate turpentine, alpha-pinene, beta-pinene, limonene, camphene, coumarone-indene, a petroleum C-5 fraction, a petroleum C-9 fraction, dicyclopentadiene, alpha-methylstyrene, styrene, xylene, vinyltoluene, and mixtures thereof.

10. The method of claim 1, wherein the hydrocarbon resin is present in an amount of about 20% to about 60% by weight, based on the total weight of the rosin and hydrocarbon resin.

11. The method of claim 1, wherein the rosin and the hydrocarbon resin are incorporated into the pulp in the form of an aqueous dispersion.

12. The method of claim 1, wherein the melting point of the hydrocarbon resin is about 45° to about 150° C.

13. The method of claim 12, wherein the melting point of the hydrocarbon resin is about 70° to about 110° C.

14. The method of claim 1, wherein the cationic resin is selected from the group consisting of bis-hexamethylenetriamine-epichlorohydrin resin, poly (methyldiallylamine•HCl)-epichlorohydrin resin, diethylenetriamine-dicyandiamide-epichlorohydrin resin, epichlorohydrin-modified polyethyleneimine resin, hexamethylenediamine-epichlorohydrin resin, poly (diallylamine•HCl)-epichlorohydrin resin, diethylenetriamine/epichlorohydrin resin, triethylenetetraamine/epichlorohydrin resin, tetraethylenepentaamine/epichlorohydrin resin, imino-bis-propylamine/epichlorohydrin resin, and 1,6-hexamethylenediamine-co-1,2-dichloroethane/epichlorohydrin resin.

15. The method of claim 14, wherein the cationic polyamine resin is a polyalkylene polyamine/epichlorohydrin resin.

16. The method of claim 1, wherein the pH is about 5.5 to about 8.0; the cationic resin is selected from the group consisting of bis-hexamethylenetriamine-epichlorohydrin resin, poly(methyldiallylamine•HCl)-epichlorohydrin resin, diethylenetriamine-dicyandiamide-epichlorohydrin resin, epichlorohydrin-modified polyethyleneimine resin, hexamethylenediamine-epichlorohydrin resin, poly (diallylamine•HCl)-epichlorohydrin resin, diethylenetriamine/epichlorohydrin resin, triethylenetetraamine/epichlorohydrin resin, tetraethylenepentaamine/epichlorohydrin resin, imino-bis-propylamine/epichlorohydrin resin, and 1,6-hexamethylenediamine-co-1,2-dichloroethane/epichlorohydrin resin; the hydrocarbon resin is selected from the group consisting of polymerized steam distilled wood turpentine, distilled sulfate turpentine, alpha-pinene, beta-pinene, limonene, camphene, coumarone-indene, a petroleum C-5 fraction, a petroleum C-9 fraction, dicyclopentadiene, alpha-methylstyrene, styrene, xylene, vinyltoluene, and mixtures thereof, and alum is present in an amount of 0.1 to 0.3% by weight.

17. The method of claim 16, wherein the alum is aluminum sulfate.

18. The method of claim 1, wherein the pH is about 5.5 to about 8.0; the cationic resin is selected from the group consisting of bis-hexamethylenetriamine-epichlorohydrin resin, poly(methyldiallylamine•HCl)-epichlorohydrin resin, diethylenetriamine-dicyandiamide-epichlorohydrin resin, epichlorohydrin-modified polyethyleneimine resin, hexamethylenediamine-epichlorohydrin resin, poly (diallylamine•HCl)-epichlorohydrin resin, diethylenetriamine/epichlorohydrin resin, triethylenetetraamine/epichlorohydrin resin, tetraethylenepentaamine/epichlorohydrin resin, imino-bis-propylamine/epichlorohydrin resin, and 1,6-hexamethylenediamine-co-1,2-dichloroethane/epichlorohydrin resin; the hydrocarbon resin is selected from the group consisting of polymerized steam distilled wood turpentine, distilled sulfate turpentine, alpha-pinene, beta-pinene, limonene, camphene, coumarone-indene, a petroleum C-5 fraction, a petroleum C-9 fraction, dicyclopentadiene, alpha-methylstyrene, styrene, xylene, vinyltoluene, and mixtures thereof, and the method is carried out in the absence of alum.

19. The method of claim 18, wherein the method is carried out in the absence of aluminum sulfate.

20. The method of claim 1, wherein the rosin and hydrocarbon resin are added as a blend.

21. The method of claim 1, wherein the rosin and hydrocarbon resin are added as a blend and the hydrocarbon resin is present in an amount of about 20% to about 60% by weight, based on the total weight of the rosin/hydrocarbon resin blend.

22. The method of claim 2, wherein the rosin and the hydrocarbon resin are incorporated into the paper pulp in the form of an aqueous dispersion.

23. The method of claim 17, wherein the rosin and hydrocarbon resin are added as a blend.

24. The method of claim 19, wherein the rosin and hydrocarbon resin are added as a blend.

25. The method of claim 1, wherein the rosin is selected from the group consisting of wood rosin, gum rosin, tall oil rosin, and mixtures thereof.

26. The method of claim 1, wherein the rosin is selected from the group consisting of fortified rosins, partially or substantially completely hydrogenated rosins and polymerized rosins, and rosins that have been treated to inhibit crystallization by heat treatment or reaction with formaldehyde.

27. The method of claim 1, wherein the rosin is selected from the group consisting of fortified rosins prepared by reacting rosin with α,β-unsaturated monobasic and polybasic organic acids and acid anhydrides.

28. The method of claim 27, wherein the α,β-unsaturated monobasic and polybasic organic acids and acid anhydrides are selected from the group consisting of acrylic, maleic, fumaric, itaconic and citraconic acids and their anhydrides.

29. A method for sizing paper or paperboard said method consisting essentially of incorporating into the paper or paperboard pulp at a pH of about 5.0 to about 8.5 a sizing composition consisting essentially of (a) about 0.1 to about 1% by weight of rosin, based upon the dry weight of the pulp, (b) about 10 to about 90% of at least one hydrocarbon resin, based upon the total weight of the rosin and hydrocarbon resin, (c) a cationic component consisting essentially of a cationic polyamine resin, wherein the weight ratio of the rosin and hydrocarbon resin to cationic resin is about 5:1 to about 1:2 and the cationic polyamine resin is selected from the group consisting of polyalkyleneamine-epihalohydrin resins, polyalkyleneamine-dicyandiamide-epihalohydrin resins, poly(diallylamine•HCl)-epihalohydrin resins, poly (methyldiallylamine•HCl)-epihalohydrin resins, epihalohydrin-modified polyethyleneimine resins, amine-modified poly(methyldiallylamine•HCl)-epihalohydrin resins, and mixtures thereof, and (d) up to 0.1% alum, based on the dry weight of the pulp.

30. The method of claim 1, wherein the sizing agent is applied as an internal sizing agent.

31. The method of claim 7, wherein the sizing agent is applied as an internal sizing agent.

32. The method of claim 29, wherein the sizing agent is applied as an internal sizing agent.

33. A method for anchoring a rosin-based size to paper pulp, said method consisting essentially of incorporating into the paper or paperboard pulp at a pH of about 5.0 to about 8.5 a sizing composition consisting essentially of (a) about 0.1 to about 1% by weight of rosin, based upon the dry weight of the pulp, (b) about 10 to about 90% of at least one hydrocarbon resin, based upon the total weight of the rosin and hydrocarbon resin, (c) a cationic component consisting essentially of a cationic polyamine resin, wherein the weight ratio of the rosin and hydrocarbon resin to cationic resin is about 5:1 to about 1:2 and the cationic polyamine resin is selected from the group consisting of polyalkyleneamine-epihalohydrin resins, polyalkyleneamine-dicyandiamide-epihalohydrin resins, poly(diallylamine•HCl)-epihalohydrin resins, poly(methyldiallylamine•HCl)-epihalohydrin resins, epihalohydrin-modified polyethyleneimine resins, amine-modified poly(methyldiallylamine•HCl)-epihalohydrin resins, and mixtures thereof, and (d) up to 0.3% alum, based on the dry weight of the pulp.

34. The method of claim 33, wherein the pH is about 5.5 to about 8.0.

35. The method of claim 34, wherein the pH is about 6.0 to about 7.5.

36. The method of claim 33, wherein the weight ratio of rosin to cationic polyamine is about 1:1.

37. The method of claim 33, wherein alum is present in an amount of 0.1 to 0.3% by weight, based on the dry weight of the pulp.

38. The method of claim 37, wherein the alum is aluminum sulfate.

39. The method of claim 33, wherein the method is carried out in the absence of alum.

40. The method of claim 39, wherein the method is carried out in the absence of aluminum sulfate.

41. The method of claim 33, wherein the hydrocarbon resin is made from monomers selected from the group consisting of polymerized steam distilled wood turpentine, distilled sulfate turpentine, alpha-pinene, beta-pinene, limonene, camphene, coumarone-indene, a petroleum C-5 fraction, a petroleum C-9 fraction, dicyclopentadiene, alpha-methylstyrene, styrene, xylene, vinyltoluene, and mixtures thereof.

42. The method of claim 33, wherein the hydrocarbon resin is present in an amount of about 20% to about 60% by weight, based on the total weight of the rosin and hydrocarbon resin.

43. The method of claim 33, wherein the rosin and the hydrocarbon resin are incorporated into the pulp in the form of an aqueous dispersion.

44. The method of claim 33, wherein the melting point of the hydrocarbon resin is about 45° to about 150° C.

45. The method of claim 44, wherein the melting point of the hydrocarbon resin is about 70° to about 110° C.

46. The method of claim 33, wherein the cationic resin is selected from the group consisting of bis-hexamethylenetriamine-epichlorohydrin resin, poly(methyldiallylamine•HCl)-epichlorohydrin resin, diethylenetriamine-dicyandiamide-epichlorohydrin resin, epichlorohydrin-modified polyethyleneimine resin, hexamethylenediamine-epichlorohydrin resin, poly(diallylamine•HCl)-epichlorohydrin resin, diethylenetriamine/epichlorohydrin resin, triethylenetetraamine/epichlorohydrin resin, tetraethylenepentaamine/epichlorohydrin resin, imino-bis-propylamine/epichlorohydrin resin, and 1,6-hexamethylenediamine-co-1,2-dichloroethane/epichlorohydrin resin.

47. The method of claim 46, wherein the cationic polyamine resin is a polyalkylene polyamine/epichlorohydrin resin.

48. The method of claim 33, wherein the pH is about 5.5 to about 8.0; the cationic resin is selected from the group consisting of bis-hexamethylenetriamine-epichlorohydrin resin, poly(methyldiallylamine•HCl)-epichlorohydrin resin, diethylenetriamine-dicyandiamide-epichlorohydrin resin, epichlorohydrin-modified polyethyleneimine resin, hexamethylenediamine-epichlorohydrin resin, poly(diallylamine•HCl)-epichlorohydrin resin, diethylenetriamine/epichlorohydrin resin, triethylenetetraamine/epichlorohydrin resin, tetraethylenepentaamine/epichlorohydrin resin, imino-bis-propylamine/epichlorohydrin resin, and 1,6-hexamethylenediamine-co-1,2-dichloroethane/epichlorohydrin resin; the hydrocarbon resin is selected from the group consisting of polymerized steam distilled wood turpentine, distilled sulfate turpentine, alpha-pinene, beta-pinene, limonene, camphene, coumarone-indene, a petroleum C-5 fraction, a petroleum C-9 fraction, dicyclopentadiene, alpha-methylstyrene, styrene, xylene, vinyltoluene, and mixtures thereof, and alum is present in an amount of 0.1 to 0.3% by weight.

49. The method of claim 48, wherein the alum is aluminum sulfate.

50. The method of claim 33, wherein the pH is about 5.5 to about 8.0; the cationic resin is selected from the group consisting of bis-hexamethylenetriamine-epichlorohydrin resin, poly(methyldiallylamine•HCl)-epichlorohydrin resin, diethylenetriamine-dicyandiamide-epichlorohydrin resin, epichlorohydrin-modified polyethyleneimine resin, hexamethylenediamine-epichlorohydrin resin, poly(diallylamine•HCl)-epichlorohydrin resin, diethylenetriamine/epichlorohydrin resin, triethylenetetraamine/epichlorohydrin resin, tetraethylenepentaamine/epichlorohydrin resin, imino-bis-propylamine/epichlorohydrin resin, and 1,6-hexamethylenediamine-co-1,2-dichloroethane/epichlorohydrin resin; the hydrocarbon resin is selected from the group consisting of polymerized steam distilled wood turpentine, distilled sulfate turpentine, alpha-pinene, beta-pinene, limonene, camphene, coumarone-indene, a petroleum C-5 fraction, a petroleum C-9 fraction, dicyclopentadiene, alpha-methylstyrene, styrene, xylene, vinyltoluene, and mixtures thereof, and the method is carried out in the absence of alum.

51. The method of claim 50, wherein the method is carried out in the absence of aluminum sulfate.

52. The method of claim 33, wherein the rosin and hydrocarbon resin are added as a blend.

53. The method of claim 33, wherein the rosin and hydrocarbon resin are added as a blend and the hydrocarbon resin is present in an amount of about 20% to about 60% by weight, based on the total weight of the rosin/hydrocarbon resin blend.

54. The method of claim 34, wherein the rosin and the hydrocarbon resin are incorporated into the paper pulp in the form of an aqueous dispersion.

55. The method of claim 49, wherein the rosin and hydrocarbon resin are added as a blend.

56. The method of claim 51, wherein the rosin and hydrocarbon resin are added as a blend.

57. The method of claim 33, wherein the rosin is selected from the group consisting of wood rosin, gum rosin, tall oil rosin, and mixtures thereof.

58. The method of claim 33, wherein the rosin is selected from the group consisting of fortified rosins, partially or substantially completely hydrogenated rosins and polymerized rosins, and rosins that have been treated to inhibit crystallization by heat treatment or reaction with formaldehyde.

59. The method of claim 33, wherein the rosin is selected from the group consisting of fortified rosins prepared by reacting rosin with α,β-unsaturated monobasic and polybasic organic acids and acid anhydrides.

60. The method of claim 59, wherein the α,β-unsaturated monobasic and polybasic organic acids and acid anhydrides are selected from the group consisting of acrylic, maleic, fumaric, itaconic and citraconic acids and their anhydrides.

61. A method for anchoring a rosin-based size to paper pulp, said method consisting essentially of incorporating into the paper or paperboard pulp at a pH of about 5.0 to about 8.5 a sizing composition consisting essentially of (a) about 0.1 to about 1% by weight of rosin, based upon the dry weight of the pulp, (b) about 10 to about 90% of at least one hydrocarbon resin, based upon the total weight of the rosin and hydrocarbon resin, (c) a cationic component consisting essentially of a cationic polyamine resin, wherein the weight ratio of the rosin and hydrocarbon resin to cationic resin is about 5:1 to about 1:2 and the cationic polyamine resin is selected from the group consisting of polyalkyleneamine-epihalohydrin resins, polyalkyleneamine-dicyandiamide-epihalohydrin resins, poly(diallylamine•HCl)-epihalohydrin resins, poly(methyldiallylamine•HCl)-epihalohydrin resins, epihalohydrin-modified polyethyleneimine resins, amine-modified poly(methyldiallylamine•HCl)-epihalohydrin resins, and mixtures thereof, and (d) up to 0.1% alum, based on the dry weight of the pulp.

62. The method of claim 33, wherein the sizing agent is applied as an internal sizing agent.

63. The method of claim 39, wherein the sizing agent is applied as an internal sizing agent.

64. The method of claim 61, wherein the sizing agent is applied as an internal sizing agent.

* * * * *